US010036253B1

(12) United States Patent
Moberg et al.

(10) Patent No.: US 10,036,253 B1
(45) Date of Patent: Jul. 31, 2018

(54) CONTROL SYSTEM FOR MATERIAL GATHERING MECHANISM

(71) Applicant: Caterpillar Inc., Peoria, IL (US)

(72) Inventors: Carl Moberg, Dunlap, IL (US); Fabian Wolf, Essen (DE); Konstantin Halle, Selm (DE); Justin Philip Pahl, Dunlap, IL (US); Bjoern-Andre Huehn, Essen (DE)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/629,792

(22) Filed: Jun. 22, 2017

(51) Int. Cl.
*B65G 25/00* (2006.01)
*E21F 13/06* (2006.01)
*E21F 13/00* (2006.01)

(52) U.S. Cl.
CPC ..... *E21F 13/06* (2013.01); *E21F 13/002* (2013.01); *E21F 13/063* (2013.01)

(58) Field of Classification Search
CPC ..... B65G 25/00
USPC ..... 700/11, 12, 21; 198/512, 514, 517
See application file for complete search history.

(56) References Cited

U.S. PATENT DOCUMENTS 4,159,055 A 6/1979 Eberle
4,236,627 A 12/1980 Sigott et al.
4,605,119 A 8/1986 Keuschnigg et al.

FOREIGN PATENT DOCUMENTS

GB 1116453 6/1968

*Primary Examiner* — Gene O Crawford
*Assistant Examiner* — Lester III Rushin
(74) *Attorney, Agent, or Firm* — James S. Bennin

(57) ABSTRACT

A control system for a material gathering mechanism includes a gathering head configured to gather material from aground surface, a plurality of gathering members configured to transport the material gathered by the gathering head towards a material conveying apparatus, and a jam detection device for detecting a jam condition in movement of one or more of the plurality of gathering members and generate signals indicative of the jam condition. The control system further includes a controller communicably coupled to the plurality of gathering members and the jam detection member. The controller receives signals indicative of the jam condition from the jam detection device. The controller initiates a sequence of stopping, delaying, and restarting the gathering member on receiving the signals indicative of the jam condition.

20 Claims, 5 Drawing Sheets

CONTROL SYSTEM FOR MATERIAL GATHERING MECHANISM

TECHNICAL FIELD

The present disclosure generally relates to an underground machine. More specifically, the present disclosure relates to a control system for transferring material from a ground surface to a material conveying apparatus of the machine.

BACKGROUND

A machine, such as an underground mining machine, is designed for conducting mining work, such as cutting rocks. The machine may include a cutter tool for cutting the materials, a material gathering tool for collecting loose materials, and a conveying tool for transferring materials to the back of the machine for transportation via haulers or loading trucks. A rock cutting machine, such as the underground mining machine, is provided with a pair of loading arms or devices for facilitating transfer of materials to a conveying tool.

The loading arms or devices move together from one end of the material gathering tool to another end for directing the cut material towards the conveying tool. The loading arms or devices may rotate, or perform any other type of movement depending on type of drive, shape of the loading arms, and size of cut materials being handled, among others. Bigger lumps of cut material or larger volumes of cut materials may jam the loading arms or devices. In some cases, only one of the loading arms or devices may be jammed but both of them may have to be stopped for clearing the jam, reducing productivity. Further, jamming of the loading arms or devices causes pressure spikes in fluid-driven systems, strain and fatigue in mechanically-driven systems, and heating or other such problems in electrically-driven systems. Over a period of time, the durability of the parts and the productivity of the machine are adversely affected.

G.B. Patent No. 1,116,453 (hereinatter referred to as '453 reference) describes a loader-conveyor machine having two endless chains and a pair of gathering arms for handling materials. The '453 reference includes a reversible drive means for the two endless chains to release jammed materials by reversing direction of movement. However, the '453 reference does not disclose details about any solution for materials jammed in the pair of gathering arms.

Therefore, an improved control system for material gathering mechanism of the machine is required.

SUMMARY

In an aspect of the present disclosure, a control system for a material gathering mechanism is provided. The control system includes a gathering head configured to gather material from a ground surface, a plurality of gathering members configured to transport the material gathered by the gathering head towards a material conveying apparatus, and a jam detection device configured to detect a jam condition in movement of one or more of the plurality of gathering members, and generate signals indicative of the jam condition. The control system further includes a controller communicably coupled to the plurality of gathering members, and the jam detection device. The controller receives signals indicative of the jam condition from the jam detection device. The controller stops the movement of the gathering member for a first time interval. The controller reverses direction of movement of the gathering member for a second time interval. The controller then stops the movement of the gathering member for a third time interval. Further, the controller reverses direction of movement of the gathering member.

In another aspect of the present disclosure, a method for controlling a material gathering mechanism is disclosed. The method includes receiving signals indicative of a jam condition of at least one gathering member by the controller. The method includes stopping movement of the gathering member for a first time interval by the controller. The method includes reversing direction of movement of the gathering member for a second time interval by the controller. The method includes stopping the movement of the gathering member for a third time interval by the controller. The method further includes reversing direction of movement of the gathering member by the controller.

In yet another aspect of the present disclosure, a machine including a material gathering mechanism for transferring material from a ground surface to a material conveying apparatus is disclosed. The machine includes the material gathering mechanism and the controller. The material gathering mechanism includes a gathering head configured to gather material from the ground surface, at least one gathering member configured to shift the material gathered by the gathering head towards the material conveying apparatus, and a jam detection device configured to detect a jam condition in movement of the gathering member, and generate signals indicative of the jam condition. The controller is communicably coupled to the material gathering mechanism. The controller receives signals indicative of the jam condition from the jam detection device. The controller stops the movement of the gathering member for a first time interval. The controller reverses direction of movement of the gathering member for a second time interval. The controller then stops the movement of the gathering member for a third time interval. Further, the controller reverses direction of movement of the gathering member.

DETAILED DESCRIPTION

Figure 1:
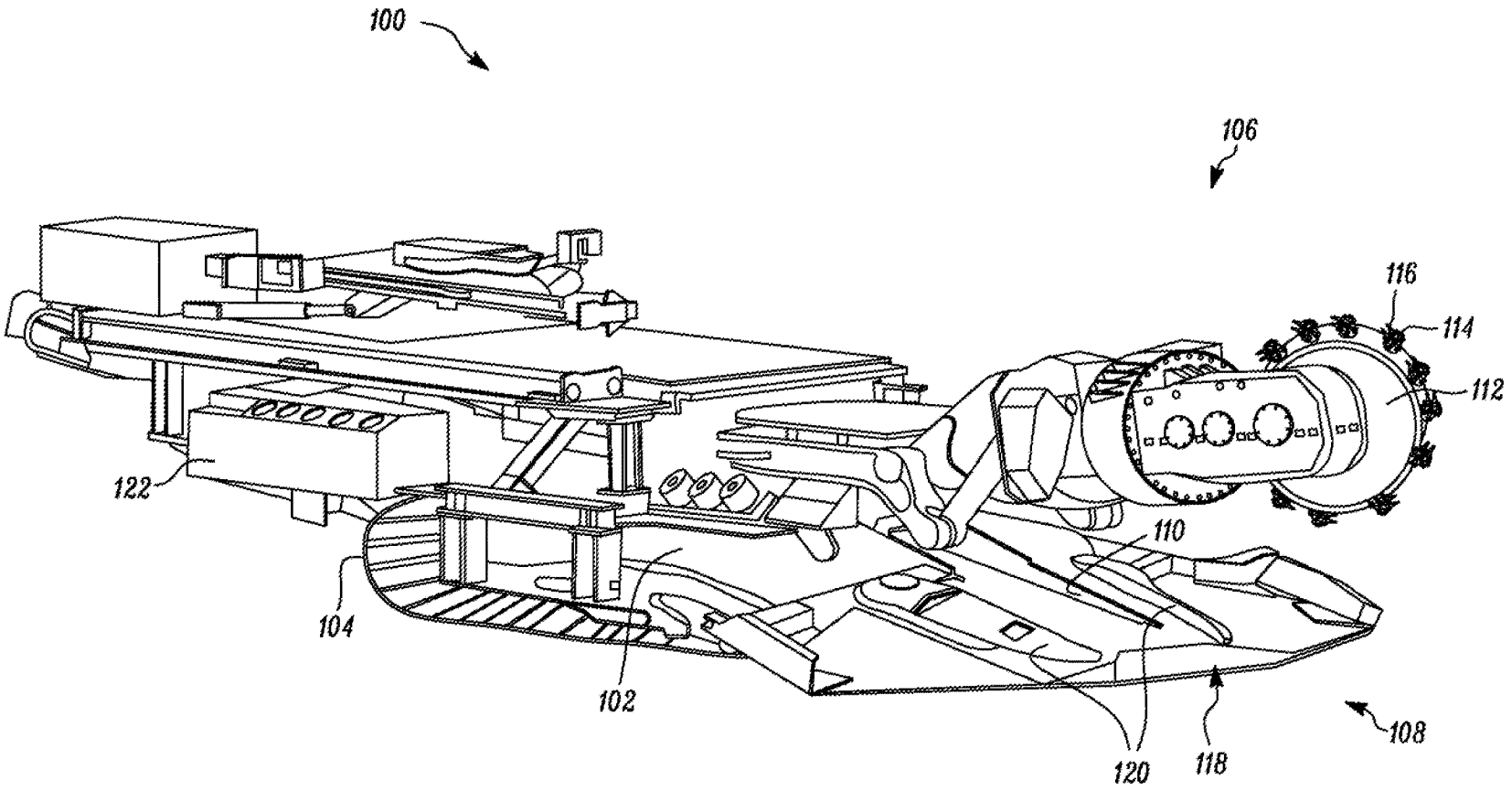
FIG. 1 is a perspective view of an exemplary underground mining machine, in accordance with an embodiment of the present disclosure.

Wherever possible, the same reference numbers will be used throughout the drawings to refer to same or like parts. FIG. 1 shows an exemplary machine 100. The machine 100 is illustrated as an exemplary underground mining machine which may be used, for example, to perform a mining operation in which materials (such as ore, coal, other minerals, or rocks) are broken-off from the earth, such as from a face of a mine. While the following detailed description describes an exemplary aspect in connection with the underground mining machine, it should be appreciated that the description applies equally to the use of the present disclosure in other machines, such as loaders, excavators, etc.

The machine 100 includes a frame 102. The frame 102 supports all tools necessary to mine and all systems necessary to operate the machine 100. The frame 102 may be movably supported on a ground engaging element 104, which is embodied exemplarily in the form of crawlers as shown in the illustrated embodiment of FIG. 1. Although, the ground engaging element 104 is illustrated as continuous tracks here, it should be contemplated that the ground engaging element 104 may be any other type of ground engaging elements as well, such as, for example, wheels etc.

The machine 100 further includes a rotary cutting tool 106, and a material gathering mechanism 108 for conducting work, for example, to transfer material from a ground surface to a material conveying apparatus 110 or otherwise collect material. In some embodiments, the material conveying apparatus 110 may include a conveyor, a belt, or any other such suitable conveying apparatus.

The rotary cutting tool 106 may be implemented by a rotary head 112 bearing a series of cutting pods 114 thereon. Each of the cutting pods 114 includes a plurality of cutter bits 116 disposed thereon. It may be noted that a configuration of the rotary cutting tool 106 disclosed in the illustrated embodiment of FIG. 1 is non-limiting of this disclosure. Persons skilled in the art will acknowledge that the configuration of the rotary cutting tool 106 used on the machine 100 may vary from one application to another depending on specific requirements of an application. The rotary cutting tool 106 may be driven by a motor (not shown) or any other such power source.

Further referring to FIG. 1, the material gathering mechanism 108 includes a gathering head 118, a plurality of gathering members 120 (individually as gathering member 120), and a jam detection device 122. The gathering head 118 is coupled to the frame 102, and is configured to gather material from the ground surface. In some embodiments, the gathering head 118 may be a plate-like structure capable of any suitable type of movement for gathering the material from the ground surface. The jam detection device 122 detects a jam condition regarding movement of the plurality of gathering members 120, and is described later in the disclosure. In an embodiment, the jam detection device 122 may include, for example, a temperature sensor, an IR sensor, an ultrasonic sensor, a touch sensor, a pressure sensor, a current sensor, etc. In some embodiments, the jam detection device 122 may be configured to differentiate between the jam condition of the movement of the gathering member 120 and a condition when the gathering member 120 is at an end position of the movement. In some embodiments, the gathering member 120 may reach the end position of the movement by traversing a particular distance (e.g., a maximum permissible distance allowed to be traveled without adversely affecting the working of the machine 100). Additionally, or alternatively, the jam detection device 122 may identify the end position of the movement of the gathering member by using sensing devices, including, for example, a pressure sensor, a temperature sensor, a movement sensor, or a proximity sensor, etc.

In the illustrated embodiment, the plurality of gathering members 120 are movably coupled to the gathering head 118. The plurality of gathering members 120 are configured to shift the material gathered by the gathering head 118 towards the material conveying apparatus 110. In some instances, the material conveying apparatus 110 may be jammed by the material. In some embodiments, the jam detection device 122 may be configured to differentiate between the jam condition of the movement of the plurality of gathering members 120 and a jam condition of the movement of the material conveying apparatus 110. In an exemplary embodiment, by comparing data of the jam detection device 122 for the plurality of gathering members 120 with that of the material conveying apparatus 110, the jam condition may be identified. In some embodiments, the gathering member 120 and the material conveying apparatus 110 may be powered by driving apparatuses (not shown). In some embodiments, the driving apparatus may include, for example, mechanical, electrical, and/or the like. In some embodiments, by referring to corresponding data of the mechanical, electrical, or similar type of driving apparatuses of the gathering member 120, and that of the material conveying apparatus 110, the jam condition may be identified. In an instance, if the driving apparatuses are electrically powered, the corresponding electric current value powering the driving apparatuses is referred for jam condition identification.

Figure 2:
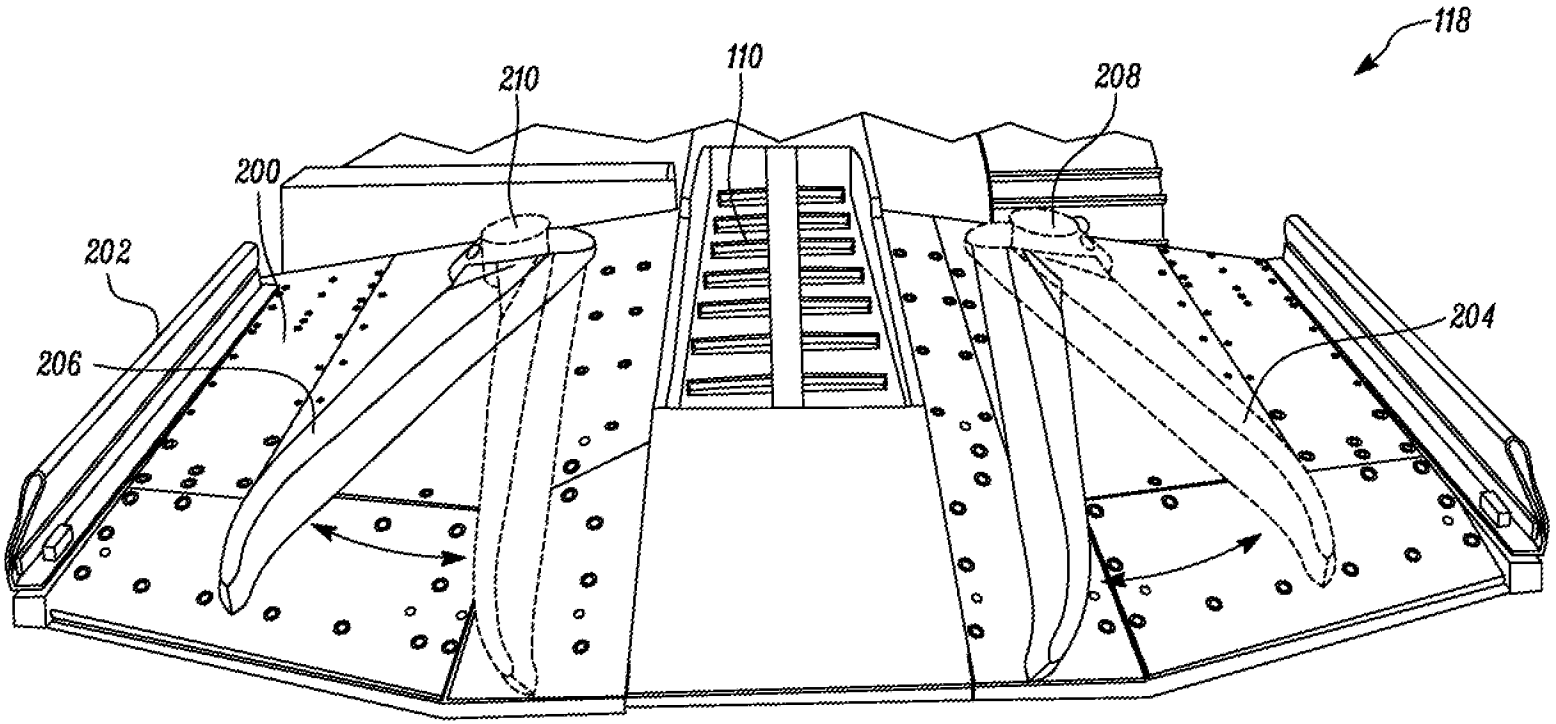
FIG. 2 is a zoomed-in front elevational view of an exemplary gathering head of the machine having at least one gathering member, in accordance with an embodiment of the present disclosure.

Now referring to FIG. 2, the gathering head 118 is illustrated. The gathering head 118 includes a base 200, a pair of side walls 202, and the material conveying apparatus 110. In some embodiments, the pair of side walls 202 may be movable. For example, the pair of side walls 202 may move towards, or away from the material conveying apparatus 110. The material conveying apparatus 110 may transfer materials gathered by the gathering member 120 to a rear portion of the machine 100 for transportation.

In some embodiments, the gathering member 120 may reach the end position of the movement by traversing a maximum permissible distance allowed to be traveled without adversely affecting the working of the machine 100. In an embodiment, the jam detection device 122 may identify the end position of the movement of the gathering member 120 by using detecting devices, including, for example, a pressure sensor, a temperature sensor, a movement sensor, or a proximity sensor, etc. The jam detection device 122 may identify the end position, for example, by comparing measured pressure if the jam detection device 122 is powered by fluidic drive, or by comparing measured movement to a pre-defined movement.

The plurality of gathering members 120 includes a first gathering arm 204 and a second gathering arm 206. The first gathering arm 204 is movably coupled to the base 200 via a first mounting assembly 208, and is driven by the driving apparatus. The second gathering arm 206 is movably coupled to the base 200 via a second mounting assembly 210, and is driven by the driving apparatus. In some embodiments, the first gathering arm 204 and the second gathering arm 206 may move independently or move in a coordinated manner to cause the materials to move towards the material conveying apparatus 110.

Figure 3:
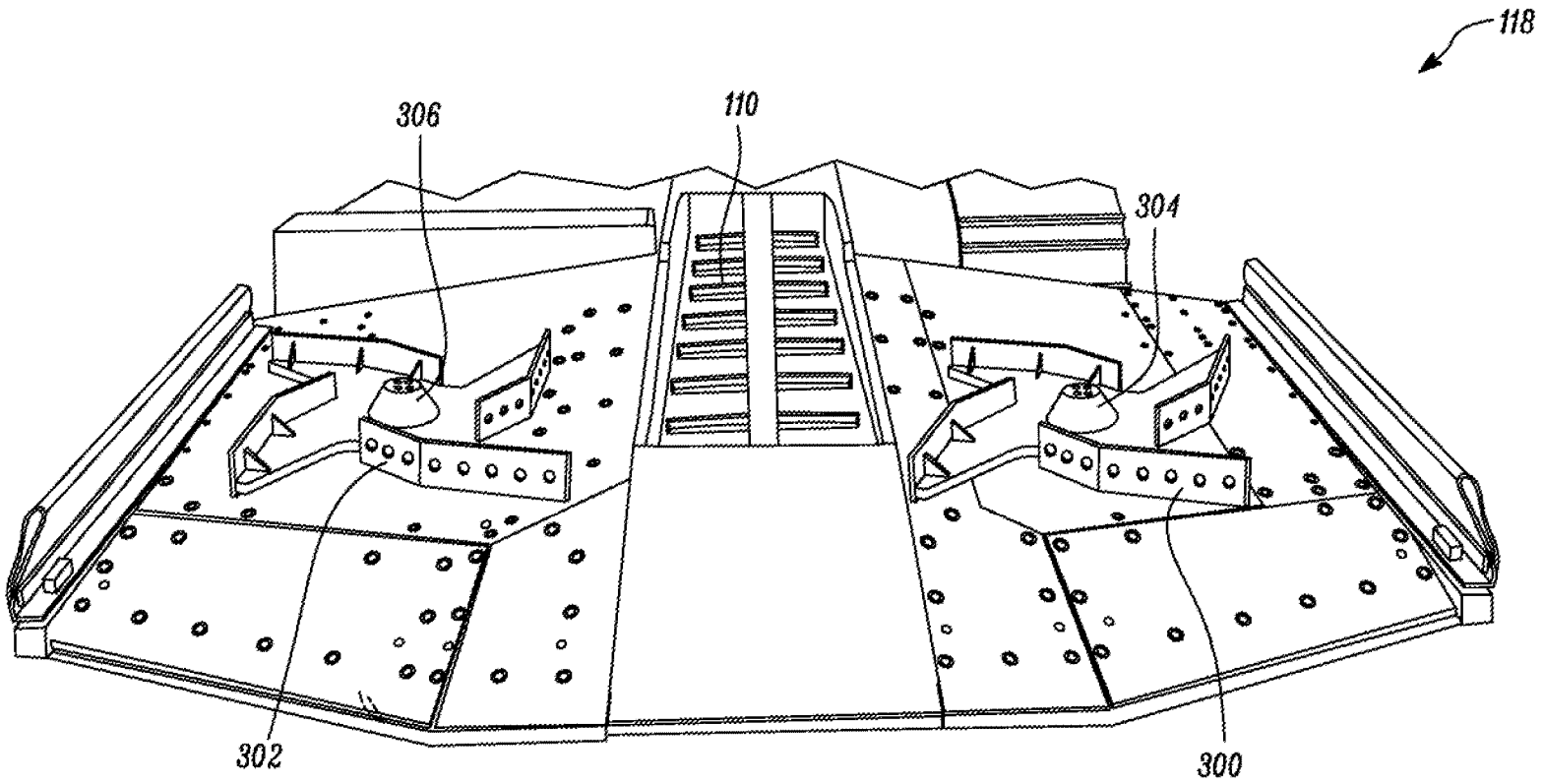
FIG. 3 is another zoomed-in elevational view of another exemplary gathering head of the machine having at least one gathering member, in accordance with an embodiment of the present disclosure.

As shown in FIG. 3, the gathering head 118 is illustrated in another exemplary embodiment. The plurality of gathering members 120 includes a first gathering star 300 and a second gathering star 302. The first gathering star 300 is coupled to the gathering head 118 via a third mounting assembly 304, and is driven by the driving apparatus. The second gathering star 302 is coupled to the gathering head 118 via a fourth mounting assembly 306, and is driven by the driving apparatus. In some embodiments, the first gathering star 300 may move in a clockwise manner and the second gathering star 300 may move in a counter-clockwise manner, when seen from front of the machine 100 and in a top-view. In some embodiments, the first gathering start 300 and the second gathering star 302 may move (or rotate) in a similar rotational direction. Alternatively, the first gathering start 300 and the second gathering star 302 may move (or rotate) in a different rotational direction relative to each other.

In some embodiments, the gathering member 120 may be electrically, mechanically, hydraulically, or pneumatically driven via corresponding mounting assembly. In other embodiments, a movement of the gathering member 120 may be configured according to the type of energy or power source utilized for driving the gathering member 120. For example, specific steps of the movement of the gathering member 120 may be designed differently for a mechanical or hydraulic or electrical drive.

Figure 4:
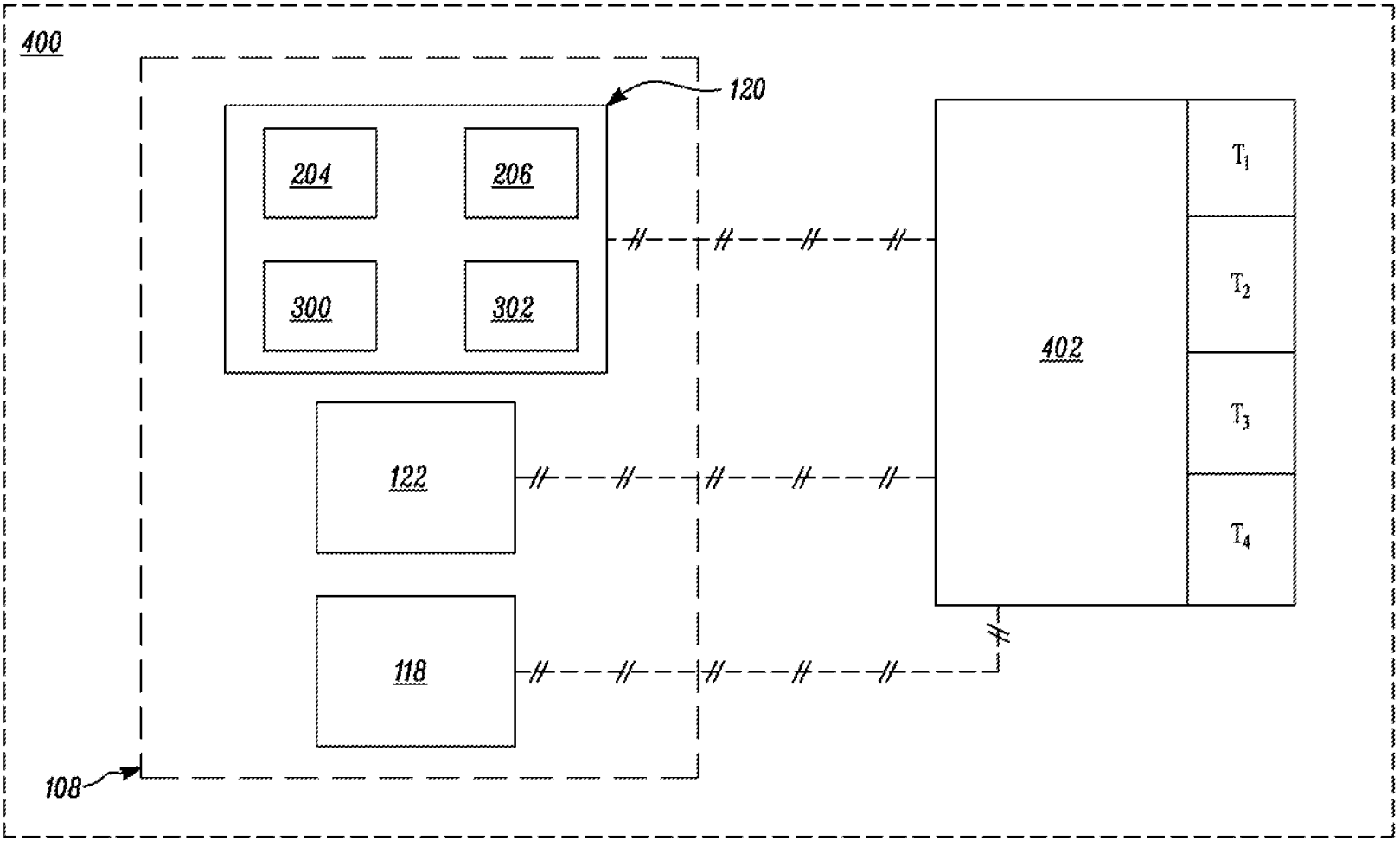
FIG. 4 is a block diagram schematically depicting a control system for the machine, in accordance with an embodiment of the present disclosure.

FIG. 4 shows a control system 400 for controlling the machine 100. The control system 400 includes the gathering head 118, the at least one gathering member 120, the jam detection device 122, and a controller 402. The controller 402 may be a single controller or multiple controllers working together to perform a variety of tasks. The controller 402 may embody a single or multiple microprocessors, field programmable gate arrays (FPGAs), digital signal processors (DSPs), etc., that include a means for detecting the jam condition in the gathering member 120. Numerous commercially available microprocessors can be configured to perform the functions of the controller 402. Various known circuits may be associated with the controller 402, including power supply circuitry, signal-conditioning circuitry, actuator driver circuitry (i.e., circuitry powering solenoids, motors, or piezo actuators), and communication circuitry.

As illustrated in FIG. 4, the controller 402 is in communication with the gathering member 120 and the jam detection device 122. In some embodiments, the jam detection device 122 may be one or more of a position sensor, a pressure sensor, a speed sensor, a flow sensor, an electric current sensor, and a rotary encoder etc. For example, the jam detection device 122 may be the position sensor calculating (or otherwise determining) a position of the gathering member 120. Additional, or alternatively, the jam detection device 122 may be the pressure sensor calculating (or otherwise determining) a pressure being generated inside the hydraulic drive fluidly powering the gathering member 120 and comparing to a threshold pressure. Additionally, or alternatively, the jam detection device 122 may be the speed sensor estimating a current speed of the gathering member 120 when moving on the base 200, or the flow sensor measuring flow of fluids inside the conduit powering the gathering member 120, or the electric current sensor measuring current powering the electric drive of gathering member 120, or the rotary encoder deducing a present angular motion of the gathering member 120. Additionally, or alternatively, the current speed of the gathering member 120 provides detailed movements, and thus a jam condition may be detected if the speed is below a threshold. Additionally, or alternatively, spikes in the reading of the flow sensor may signify a flow blockage, or a jam condition. The flow sensor may detect a spike if the measured pressure of the hydraulic drive exceeds a threshold or below a threshold. Additionally, or alternatively, the measured current exceeding a threshold value or below the threshold value, may be a sign of the jam condition detection.

It should be contemplated that the control system 400 may include various other sensors as well to measure various other parameters related to the machine 100. In some embodiments, the control system 400 may be positioned onboard the machine 100. In other embodiments, the control system 400 may be positioned at an off-board location relative to the machine 100. The present disclosure, in any manner, is not restricted to the type of controller 402 as well as the positioning of the control system 400 relative to the machine 100.

With combined reference to FIGS. 1-4, the controller 402 receives signals indicative of the jam condition from the jam detection device 122. In some embodiments, the controller 402 may receive signals indicative of the jamming of either the first gathering arm 204, the second gathering arm 206, or both the first gathering arm 204 and the second gathering arm 206. Additionally, or alternatively, the controller 402 may receive signals indicative of the jamming of either the first gathering star 300, the second gathering star 302, or both the first gathering star 300 and the second gathering star 302. Additionally, or alternatively, the controller 402 may receive signals indicative of a jam condition in the material conveying apparatus 110. The controller 402 stops the movement of the gathering member 120 for a first time interval T1 based on receiving the signals. The controller 402 then reverses direction of movement of the gathering member 120 for a second time interval T2. The controller 402 again stops the movement of the gathering member 120 for a third time interval T3. In some embodiments, the third time interval T3 may be equal to the first time interval T1. The controller 402 then reverses direction of movement of the gathering member 120.

In some embodiments, the controller 402 may determine whether the jam condition is resolved or unresolved based on the movement of the gathering member 120. For example, the controller 402 may determine the resolution of the jam condition based on the pressure spikes in the hydraulic drive (not shown) of the gathering member 120, or a spike in measured current powering the electric drive of the gathering member 120, or similar parameters recorded by the controller 402. In other embodiments, the controller 402 may compare various monitored parameters of the machine 100. For example, a variation in measured load on prime movers of the machine 100 due to the hydraulic or other such drives powering the gathering member 120 may be used for resolution of the jam condition. The controller 402 may receive a signal indicative of the jam condition being unresolved even after reversal of a direction of movement of the gathering member 120 for more number of times than a threshold during a fourth time interval T4. The controller 402 may compare the computed number of occurrences to the threshold. In some embodiments, the controller 402 may stop the movement of the gathering member 120, if the computed number of occurrences exceeds the threshold in the fourth time interval T4. The controller 402 may then issue a notification or a warning indicating a jam event of the gathering member 120. The notification or the warning may be displayed onboard the machine 100 or at a back-office at which concerned personnel may be present. In some embodiments, the controller 402 may differentiate between the jam condition in the movement of the gathering member 120 and the condition when the gathering member 120 is at the end position of the movement, before issuing the notification or the warning. The controller 402 may differentiate the end position of the movement of the gathering member 120, based on one or more of proximity sensors, position sensors, pressure sensors, etc.

INDUSTRIAL APPLICABILITY

Figure 5:
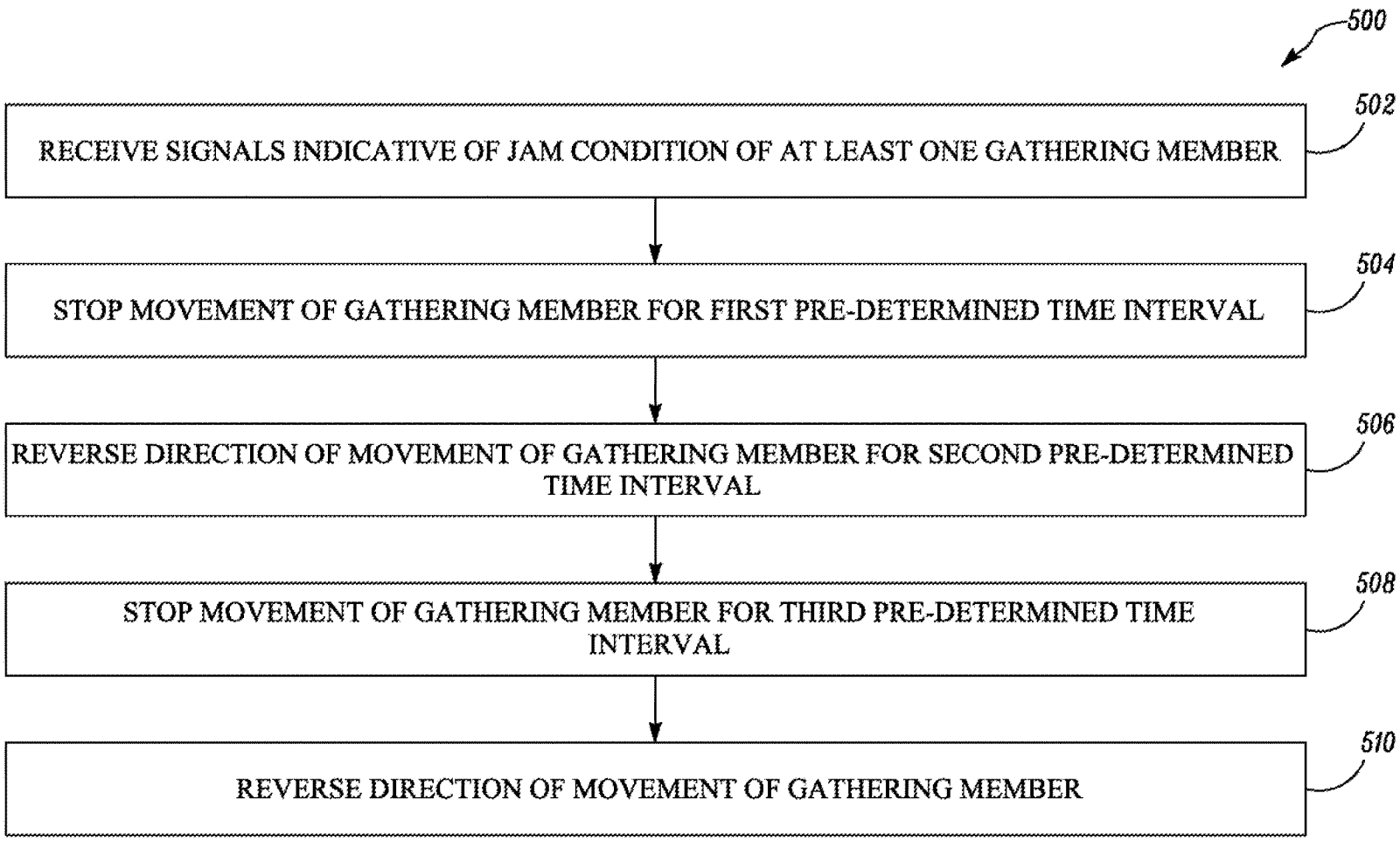
FIG. 5 is a flow chart depicting a method of transferring material from a ground surface to a material conveying apparatus, in accordance with an embodiment of the present disclosure.

The present disclosure provides an improved method 500 for controlling the material gathering mechanism 108 of the machine 100. The method 500 for controlling the material gathering mechanism 108 to transfer material from the ground surface to the material conveying apparatus 110 is illustrated with the help of FIG. 5. In an embodiment, the machine 100 is switched on and is operating to perform a mining operation.

The method 500 at step 502 includes receiving the signals indicative of the jam condition of a gathering member 120 by the controller 402. The signal may be generated by the jam detection device 122. The method 500 at step 504 includes stopping movement of the gathering member 120 for the first time interval T1 by the controller 402. The method 500 at step 506 includes reversing direction of movement of the gathering member 120 for the second time interval T2 by the controller 402. The reversal of direction of movement after stopping attempts to give a motion or jolt to the loose materials in order to clear the jam. The method 500 at step 508 includes stopping the movement of the at least one gathering member 120 for the third time interval T3 by the controller 402. The method 500 at step 510 includes reversing direction of movement of the gathering member 120 by the controller 402. The selective order of stopping and reversing ensures that the gathering member 120 is cleared out of materials which may be obstructing the movement of the gathering member 120, thereby jamming the transfer of materials to the material conveying apparatus 110 and causing the jam event.

In some embodiments, the method 500 may further include receiving the signal indicative of the jam condition of the movement of the material conveying apparatus 110. The signal may be generated by the jam detection device 122. The method 500 may further include differentiating between the jam condition of the movement of the gathering member 120 and the jam condition of the movement of the material conveying apparatus 110. In some instances, by comparing corresponding data of the mechanical, electrical, or similar type of driving apparatuses of the gathering member 120, and that of the material conveying apparatus 110 to a threshold, the jam condition may be identified. The method 500 may further include detecting the jam condition of the material conveying apparatus 110. For example, the jam condition may be detected by comparing received operating data from the material conveying apparatus 110 to a threshold. The method 500 may further include stopping the movement of the gathering member 120 if the jam condition of the material conveying apparatus 110 is detected. In some embodiments, the method 500 may further include identifying whether the jam condition is unresolved, based on movement of the gathering member 120. The movement of the gathering member 120 may be measured by the jam detection device 122 and notified to the controller 402. For example, the controller 402 may determine the resolution or non-resolution of the jam condition based on the pressure spikes in the hydraulic drive (not shown), or a spike in measured current powering the electric drive, both drives powering the gathering member 120. Similarly, the method 500 may include computing the number of occurrences of reversal of direction of movement of the gathering member 120 during the fourth time interval T4, when the jam condition is unresolved. In an embodiment, the number of occurrences are stored in the memory of the controller 402 or are accessed from outside. In other embodiments, the number of occurrences may be notified by the jam detection device 122.

The method 500 may further include comparing the occurrences to the threshold. In some embodiments, the threshold may be based on a number of occurrences of reversal of direction set by the operator. Additionally. or alternatively, the threshold may be defined by a maximum permissible limit of reversals for the driving apparatus without affecting functional, or structural integrity, etc. In other words, the threshold protects the gathering member 120 and the driving apparatus from being damaged due to failures caused by cyclical load or reversal for a longer period of time, thereby negatively affecting the fatigue strength.

The method 500 may also include stopping the movement of the gathering member 120 if the computed number of occurrences exceeds the threshold. In some embodiments, the movement of the gathering member 120 may be stopped without stopping the movement of another gathering member 120. Additionally, or alternatively, the movement of the plurality of gathering members 120 may be stopped. In such cases, where a combination of the gathering arms 204, 206 and the gathering stars 300, 302 are used, the movement of the plurality of gathering members 120 may be stopped together or at different instances. For example, the gathering arm 204 may continue to operate normally even if the gathering arm 206 is jammed, saving valuable operating life of the gathering member 206 for later use. This may prove beneficial for extending life of various parts without needing a substantial investment for replacements.

While aspects of the present disclosure have been particularly shown, and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system for a material gathering mechanism, the control system comprising:

a gathering head configured to gather material from a ground surface;

a plurality of gathering members configured to transport the material gathered by the gathering head towards a material conveying apparatus;

a jam detection device configured to detect a jam condition in movement of one or more of the plurality of gathering members, and generate signals indicative of the jam condition; and a controller communicably coupled to the plurality of gathering members, and the jam detection device, wherein the controller is configured to:

receive signals indicative of a jam condition, of a gathering member of the plurality of gathering members, from the jam detection device;

stop the movement of the gathering member, in a first direction, for a first time interval based on receiving the signals indicative of the jam condition;

reverse the movement of the gathering member to cause the gathering member to move in a second direction for a second time interval after stopping the movement of the gathering member, the second direction being opposite the first direction;

stop the movement of the gathering member for a third time interval after reversing the movement of the gathering member to cause the gathering member to move in a second direction;

reverse the movement of the gathering member to cause the gathering member to move in the first direction; and determine whether the jam condition has been resolved after reversing the movement of the gathering member to cause the gathering member to move in the first direction.

2. The control system of claim 1, wherein, prior to receiving the signals indicative of the jam condition, the gathering member and another gathering member, of the plurality of gathering members, are moving to transport the material gathered by the gathering head towards the material conveying apparatus, and wherein the controller is further configured to:

determine that the jam condition has not been resolved;

stop the movement of the gathering member based on determining that the jam condition is unresolved; and cause the other gathering member to continue moving after stopping the movement of the gathering member based on determining that the jam condition has not been resolved.

3. The control system of claim 2, wherein the controller is further configured to:

compute number of occurrences of reversal of direction of movement of the gathering member during a third time interval, when the jam condition is unresolved;

compare the computed number of occurrences to a threshold;

stop the movement of the gathering member, if the computed number of occurrences exceeds the threshold;

transmit a notification indicating a gathering member jam event.

4. The control system of claim 1, wherein the gathering member is powered by a hydraulic drive, and the jam detection device detects the jam condition by comparing the pressure inside the hydraulic drive, to a threshold pressure.

5. The control system of claim 1, wherein the gathering member is powered by an electric drive, and the jam detection device detects the jam condition by comparing measured current of the electric drive exceeding or below a threshold current.

6. The control system of claim 1, wherein the controller is further configured to:

differentiate between a jam condition of the movement of the gathering member and a condition when the gathering member is at an end position of the movement before issuing a notification.

7. The control system of claim 1, wherein the controller is further configured to receive signals indicative of a jam condition of the material conveying apparatus, and stop the movement of the gathering member based on receiving the signals indicative of the jam condition of the material conveying apparatus.

8. The control system of claim 1, wherein the jam detection device includes one or more of a position sensor, a pressure sensor, a speed sensor, a torque sensor, a flow sensor, or a rotary encoder.

9. A method for controlling a material gathering mechanism, the method comprising:

receiving, by a controller, signals indicative of a jam condition of at least one gathering member;

stopping, by the controller, movement of the gathering member for a first time interval;

reversing, by the controller, direction of movement of the gathering member for a second time interval;

stopping, by the controller, the movement of the gathering member for a third time interval; and reversing, by the controller, direction of movement of the gathering member.

10. The method of claim 9, wherein, prior to receiving the signals indicative of the jam condition, the gathering member and another gathering member, of the plurality of gathering members, are moving to transport the material gathered by the gathering head towards the material conveying apparatus, and wherein the method further includes:

determining, by the controller, whether the jam condition has not been resolved;

stop, by the controller, movement of the gathering member based on determining that the jam condition is unresolved; and cause, by the controller, the other gathering member to continue moving after stopping the movement of the gathering member based on determining that the jam condition has not been resolved.

11. The method of claim 10, wherein the method further includes:

determining, by the controller, whether the jam condition is unresolved, based on movement of the gathering member.

12. The method of claim 11, wherein the method further includes:

computing, by the controller, number of occurrences of reversal of direction of movement of the gathering member during a fourth time interval, when the jam condition is unresolved;

comparing, by the controller, the computed number of occurrences to a threshold;

stopping, by the controller, the movement of the gathering member, if the computed number of occurrences exceeds the threshold; and transmitting, by the controller, a notification indicating a gathering member jam event.

13. The method of claim 9, wherein the method further includes comparing, by the controller, the pressure generated inside the hydraulic drive, to a threshold pressure.

14. The method of claim 9, wherein the method further includes stopping, by the controller, the movement of the gathering member, if a jam condition of the material conveying apparatus is detected.

15. A machine comprising:

a material gathering mechanism configured to transfer material from a ground surface to a material conveying apparatus, the material gathering mechanism including:

a gathering head configured to gather material from the ground surface;

at least one gathering member configured to shift the material gathered by the gathering head towards the material conveying apparatus; and a jam detection device configured to detect a jam condition in movement of the gathering member, and generate signals indicative of the jam condition; and a controller communicably coupled to the material gathering mechanism, wherein the controller is configured to:

receive signals indicative of the jam condition from the jam detection device;

stop the movement of the gathering member for a first time interval;

reverse direction of movement of the gathering member for a second time interval;

stop the movement of the gathering member for a third time interval; and reverse direction of movement of the gathering member.

16. The machine of claim 15, wherein the controller is further configured to:

determine whether the jam condition is unresolved, based on movement of the gathering member.

17. The machine of claim 16, wherein the controller is further configured to:

compute number of occurrences of reversal of direction of movement of the gathering member during a fourth time interval, when the jam condition is unresolved;

compare the computed number of occurrences to a threshold;

stop the movement of the gathering member, if the computed number of occurrences exceeds the threshold; and transmit a notification indicating a gathering member jam event.

18. The machine of claim 15, wherein the gathering member is powered by a hydraulic drive, and the jam detection device detects the jam condition by comparing the pressure inside the hydraulic drive, to a threshold pressure.

19. The machine of claim 15, wherein the gathering member is powered by an electric drive, and the jam detection device detects the jam condition by comparing measured current of the electric drive exceeding or below a threshold current.

20. The machine of claim 15, wherein the controller is further configured to receive signals indicative of a jam condition of the material conveying apparatus, and stop the movement of the gathering member based on receiving the signals indicative of the jam condition of the material conveying apparatus.

* * * * *